US008431189B2

(12) United States Patent
Lee

(10) Patent No.: US 8,431,189 B2
(45) Date of Patent: Apr. 30, 2013

(54) CARBON NANOTUBE-NANOFIBER COMPOSITE STRUCTURE

(75) Inventor: Kwangyeol Lee, Namyangju-si (KR)

(73) Assignee: Korea University Research and Business Foundation, Seoul (KR)

( * ) Notice: Subject to any disclaimer, the term of this patent is extended or adjusted under 35 U.S.C. 154(b) by 532 days.

(21) Appl. No.: 12/645,219

(22) Filed: Dec. 22, 2009

(65) Prior Publication Data

US 2011/0151736 A1 Jun. 23, 2011

(51) Int. Cl.
*C23C 16/00* (2006.01)

(52) U.S. Cl.
USPC ..... 427/249.1; 427/248.1

(58) Field of Classification Search ..... 427/248.1, 427/249.1
See application file for complete search history.

(56) References Cited

U.S. PATENT DOCUMENTS

| | | | | |
|---|---|---|---|---|
| 4,838,914 | A | 6/1989 | Ohta et al. | |
| 5,948,714 | A | 9/1999 | Ishikawa et al. | |
| 6,382,526 | B1 | 5/2002 | Reneker et al. | |
| 6,520,425 | B1 | 2/2003 | Reneker | |
| 6,695,992 | B2 | 2/2004 | Reneker | |
| 2006/0226580 | A1 | 10/2006 | Xia et al. | |
| 2007/0189953 | A1* | 8/2007 | Bai et al. | 423/414 |
| 2009/0220409 | A1* | 9/2009 | Curliss et al. | 423/447.2 |

FOREIGN PATENT DOCUMENTS

| | | |
|---|---|---|
| JP | 51-126300 | 11/1976 |
| JP | 52-74000 | 6/1977 |
| JP | 52-112700 | 9/1977 |
| JP | 54-61299 | 5/1979 |
| JP | 57-016029 | 1/1982 |
| WO | 2005/044723 | 5/2005 |
| WO | 2008/112755 | 9/2008 |
| WO | 2009/110885 | 9/2009 |
| WO | 2010/099487 | 9/2010 |

OTHER PUBLICATIONS

Rainer Ostermann, et al "VO Nanorods on TiO nanofiers: a new class of hierarchical nanostructure enabled by electrospinning and calcination" Nano Letters, 2006, vol. 6, No. 6 pp. 1297-1302.

G. C. Barry "Thermodynamic and Conformational Properties of Polystyrene. II. Intrinsic Viscosity Studies on Dilute Solutions of Linear Polystyrenes" The Journal of Chemical Physics, vol. 46, No. 4, Feb. 15, 1967, pp. 1338-1352.

M. T. Martinez, et al "Sensitivity of a single wall carbon nanotubes to oxidative processing: structural modification, intercalation and functionalisation" Carbon 41 (2003) pp. 2247-2256.

Yun Hang Hu, et al "Pore size distribution of single-walled carbon nanotubes" Ind. Eng. Chem. Res. 2004, 43, 708-711.

M. Eswaramoorthy, et al "A study of micropores in single-walled carbon nanotubes by the adsorption of gases and vapors" Chemical Physics Letters 304 (Apr. 30, 1999) 207-210.

Yahachi Saito, et al "Field emission from carbon nanotubes and its application to electron sources" Carbon 38, 2000) 169-182.

(Continued)

*Primary Examiner* — Kelly M Gambetta
(74) *Attorney, Agent, or Firm* — Workman Nydegger

(57) ABSTRACT

A composite structure and methods of making and using are provided. The composite structure includes at least one nanofiber having silicon-based material and at least one carbon nanotube associated with the nanofiber. The silicon-based material includes one or more of silicon carbide, silicon oxycarbide, silicon nitride and silicon oxide.

18 Claims, 3 Drawing Sheets

OTHER PUBLICATIONS

M. S. Dresselhaus, et al "Semiconducting Carbon Nanotubes" CP772, Physics of Semiconductors: 27th International Conference on the Physics of Semiconductors, pp. 25-31.
K. A. Andrianov in Vysokomolekul. Soedin., vol. 4, p. 1060 (1962).
E. G. Rochow, in Monatsh. Chem., vol. 95 p. 750 (1964).
W. Fink in Agnew. Chem., vol. 78, p. 803 (1966).
U. Wannagat in Fortsch. Chem. Forsh., vol. 9, p. 102 (1967).
B. J. Aylett "Silicon-Nitrogen Polymers" Organometallic Chemistry Reviews, 3(1968) 151-172.
Tito Trindade, et al "Nanocrystalline Semiconductors: Synthesis, Properties, and Perspectives" Chem. Mater. 2001, 13, 3843-3858.
C. B. Murray, et al "Synthesis and Characterization of Monodisperse Nanocrystals and Close-packed nanocrystal assemblies" Anu. Rev. Mater. Sci. 2000, 30:545-610.
Mark T. Swihart "Vapor-phase synthesis of nanoparticles" Current Opinion in Colloid and Interface Science 8 (2003) 127-133.
Nicalon Ceramic Fiber, COI Ceramic Inc [retrieved from Internet by the International Searching Authority Feb. 17, 2011 online: http://www.coiceramics.com/pdfs/Nicalon_1-17-06.pdf] Jan. 17, 2006.
Hou, H., and Reneker, H., "Carbon Nanotubes on Carbon Nanofibers: A Novel Structure Based on Electrospun Polymer Nanofibers," Advanced Materials, 2004, vol. 16, Issue: 1, pp. 69-73.
Kidoaki, S., et al., "Mesoscopic spatial designs of nano- and microfiber meshes for tissue-engineering matrix and scaffold based on newly devised multilayering and mixing electrospinning techniques," Biomaterials 2005 vol. 26, Issue: 1, pp. 37-46.
Li, D., and Xia, Y., "Direct Fabrication of Composite and Ceramic Hollow Nanofibers by Electrospinning," Nano Letters, 2004 vol. 4, Issue: 5, pp. 933-938.
Li, D., and Xia, Y., "Electrospinning of Nanofibers: Reinventing the Wheel?," Advanced Materials, 2004, vol. 16, Issue: 14, pp. 1151-117.
Li, D., et al., "Collecting Electrospun Nanofibers with Patterned Electrodes," Nano Letters, 2005, vol. 5, Issue: 5, pp. 913-916.
Li, D., et al., "Electrospinning Nanofibers as Uniaxially Aligned Arrays and Layer-by-Layer Stacked Films," Advanced Materials, 2004, vol. 16, Issue: 4, pp. 361-366.
Li, D., et al., "Electrospinning of Polymeric and Ceramic Nanofibers as Uniaxially Aligned Arrays," Nano Letters, 2003, vol. 3, issue: 8, pp. 1167-1171.
Li, D., et al., "Use of Electrospinning to Directly Fabricate Hollow Nanofibers with Functionalized Inner and Outer Surfaces," Small, 2005, vol. 1, Issue: 1, pp. 83-86.
Li, J. Y., et al., "Single-crystalline nanowires of SiC synthesized by carbothermal reduction of electrospun PVP/TEOS composite fibres," Nanotechnology, 2007 vol. 18, Issue: 24, pp. 45606.
Lin, T., et al., "Self-Crimping Bicomponent Nanofibers Electrospun from Polyacrylonitrile and Elastomeric Polyurethane," Advanced Materials, 2005, vol. 17, Issue: 22, pp. 2699-2703.
Loscertales, I. G., et al., "Electrically Forced Coaxial Nanojets for One-Step Hollow Nanofiber Design," Journal of the American Chemical Society, 2004, vol. 126, Issue: 17, pp. 5376-5377.
Reneker, D. H., and Chun, I., "Nanometre diameter fibres of polymer, produced by electrospinning," Nanotechnology, 1996, vol. 7, Issue: 3, pp. 216-223.
Sun, Z., et al., "Compound Core—Shell Polymer Nanofibers by Co-Electrospinning," Adv. Mater. 2003, vol. 15, Issue: 12, pp. 1929-1932.
Theron, A., et al., "Electrostatic field-assisted alignment of electrospun nanofibres," Nanotechnology, 2001, vol. 12, Issue: 3, pp. 384-390.
Xu, C. Y., et al., "Aligned biodegradable nanofibrous structure: a potential scaffold for blood vessel engineering," Biomaterials 2004, vol. 25, Issue 5, pp. 877-886.
Yu, J. H., et al., "Production of Submicrometer Diameter Fibers by Two-Fluid Electrospinning," Advanced Materials, 2004, vol. 16, Issue: 17, pp. 1562-1566.
Zhang, Y., et al., "Preparation of Core—Shell Structured Pcl-r-Gelatin Bi-Component Nanofibers by Coaxial Electrospinning," Chemistry of Materials, 2004, vol. 16, Issue: 18, pp. 3406-3409.
Zussman, E., et al., "Formation of nanofiber crossbars in Electrospinning," Applied Physics Letters, 2003, vol. 82, Issue: 6, pp. 973-975.
International Search Report and Written Opinion for International Application No. PCT/KR2010/009097 mailed on Mar. 2, 2011.

* cited by examiner

CARBON NANOTUBE-NANOFIBER COMPOSITE STRUCTURE

BACKGROUND

Nanofibers due to their extremely high surface to volume ratio compared to conventional fibers exhibit special properties, such as low density, low specific mass and high pore volume which make them appropriate for a wide range of applications, such as filtration, energy storage, and medical applications, such as drug and gene delivery, artificial blood vessels, artificial organs, tissue engineering and medical face-masks.

Nanofibers derived from ceramic materials such as zinc oxide and silicon carbide (SiC) possess optical characteristics (luminescence) that can be made use of in light and field emitters. For example, SiC nanofibers possess high mechanical strength and oxidation resistance at elevated temperature and provide an alternative for carbon nanotubes in the development of metal matrix composites. However, silicon-based nanofibers are mechanically brittle, significantly limiting their application.

SUMMARY

In one aspect, a composite structure is provided. The composite structure includes at least one nanofiber having silicon-based material and at least one carbon nanotube associated with the nanofiber. The silicon-based material includes one or more of silicon carbide, silicon oxycarbide, silicon nitride and silicon oxide.

In another aspect, a method for preparing a composite structure is provided. The method for preparing a composite structure includes associating a metal nanoparticle on at least one nanofiber including one or more of silicon carbide, silicon oxycarbide, silicon nitride and silicon oxide to produce at least one metal nanoparticle-containing nanofiber; and growing at least one carbon nanotube on the nanofiber to obtain a composite structure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTIONS OF THE DRAWINGS

DETAILED DESCRIPTION

Figure 1:
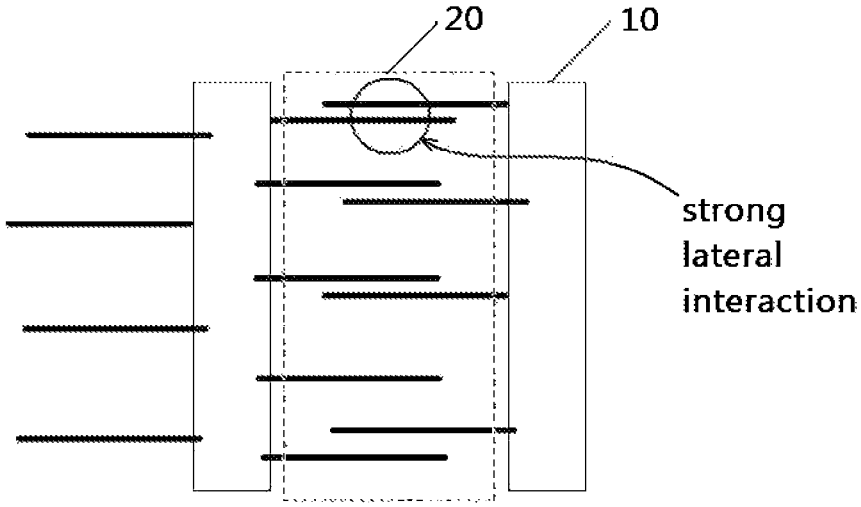
FIG. 1 depicts one illustrative embodiment of the composite structure.

In one aspect, a composite structure is provided. The composite structure includes at least one nanofiber having silicon-based material and at least one carbon nanotube associated with the nanofiber. The silicon-based material includes one or more of silicon carbide, silicon oxycarbide, silicon nitride and silicon oxide.

In one embodiment, the nanofiber may be an electrospun fiber. In another embodiment, a plurality of the nanofibers forms a nonwoven or woven web. In still another embodiment, the carbon nanotube is single-walled or multi-walled. In still yet another embodiment, the carbon nanotube includes a metal nanoparticle. The metal nanoparticle may include one or more of Fe, Mo, Co, Ni, Ti, Cr, Ru, Mn, Re, Rh, Pd, V or alloys thereof.

In still yet another embodiment, the carbon nanotube is radially oriented to the nanofiber. In still yet another embodiment, the carbon nanotube has a diameter less than that of the nanofiber. In still yet another embodiment, the carbon nanotube has a diameter from about 10 to about 500 nanometers. In still yet another embodiment, the carbon nanotube has a length from about 10 to about 10,000 nanometers.

In another aspect, a method for preparing a composite structure is provided. The method includes associating a metal nanoparticle on at least one nanofiber including one or more of silicon carbide, silicon oxycarbide, silicon nitride and silicon oxide to produce at least one metal nanoparticle-containing nanofiber, and growing at least one carbon nanotube on the nanofiber to obtain a composite structure.

In one embodiment, associating the metal nanoparticle on the at least one nanofiber includes mixing a silicon-based polymer and the metal nanoparticle to form a metal nanoparticle-containing fiber, the silicon-based polymer including one or more of polycarbosilane, polysilane, polysilazane, and polysiloxane, and heating the metal nanoparticle-containing fiber at an elevated temperature sufficient to fire the silicon-based polymer to produce the metal nanoparticle-containing nanofiber.

In another embodiment, associating the metal nanoparticle on the at least one nanofiber includes mixing a metal nanoparticle with the at least one nanofiber, and heating the mixture to produce the metal nanoparticle-containing nanofiber.

In still another embodiment, associating the metal nanoparticle on the at least one nanofiber includes mixing a metal salt with the at least one nanofiber, and heating or reducing the metal salt on the at least one nanofiber to produce the metal nanoparticle-containing nanofiber.

In one embodiment, the method further includes removing amorphous carbon from the composite structure. The removing amorphous carbon from the composite structure may be carried out by treating the composite structure with an acid.

In another embodiment, the metal nanoparticle includes one or more of Fe, Mo, Co, Ni, Ti, Cr, Ru, Mn, Re, Rh, Pd, V or alloys thereof. In still another embodiment, the elevated temperature is from about 100° C. to about 2100° C. In still yet another embodiment, the heating the nanofiber is carried out in inert atmosphere. In still yet another embodiment, the carbon nanotube is single-walled or multi-walled. In still yet another embodiment, the carbon nanotube grows from the metal nanoparticle on the nanofiber.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Carbon Nanotube-Nanofiber Composite Structure

In one illustrative embodiment, a composite includes at least one nanofiber having a silicon-based material and at least one carbon nanotube associated with the nanofiber. The silicon-based material includes silicon itself and silicon-based ceramics. The silicon-based ceramics include one or more of silicon carbide, silicon oxycarbide, silicon nitride and silicon oxide.

In some embodiments, the nanofiber may be an electrospun fiber. As used herein, a "nanofiber" means a 'nano-sized' fiber whose diameter is approximately nanometer-scaled. The nanofiber may contain metal nanoparticles which are used as growth catalysts for carbon nanotubes. To produce the electrospun fiber, a solution or melt of precursors of the silicon-based material is subjected to a high-voltage electrical field to produce an electrically charged jet that typically dries or solidifies to produce a solid fiber. The precursors may be polycarbosilane and polysilane for silicon carbide, polysiloxane for silicon oxycarbide and silicon oxide, and polysilazane for silicon nitride. In another embodiment, a plurality of the nanofibers may form a linear fiber assembly or a nonwoven or woven web. As used herein the term "nonwoven web" refers to a structure or a web of material that has been formed without use of traditional fabric forming processes, such as weaving or knitting, to produce a structure of individual fibers or threads that are intermeshed, but not in an identifiable, repeating manner as is found in typical woven webs. For example, nanofibers which are formed using electrospinning are typically in the form of a nonwoven web. On the contrary, as used herein the term "woven web" refers to a structure or web of material that has been formed with the use of traditional fabric forming processes, such as weaving or knitting. In the woven web, individual fibers or threads are intermeshed in an identifiable, repeating manner. Thus, the as-produced individual fibers or threads may be arranged in any desired direction to form a woven or knitted web.

As used herein nanofibers are fibers having an average diameter in the range of about 1 nm to about 25,000 nm. In another embodiment, the nanofibers may be fibers that have an average diameter in the range of about 1 nanometer to about 10,000 nm, or about 1 nm to about 5,000 nm, or about 3 nm to about 3,000 nm, or about 7 nm to about 1,000 nm, or about 10 nm to about 500 nm. In another embodiment, the nanofibers may be fibers that have an average diameter of less than about 25,000 nm, or less than about 10,000 nm, or less than about 5,000 nm. In still another embodiment, the nanofibers may be fibers that have an average diameter of less than about 3,000 nm, or less than about 1,000 nm, or less than about 500 nm. Additionally, it should be noted that here, as well as elsewhere in the text, ranges may be combined. The diameters of the nanofibers may be substantially same or varied along their length. In the latter case, the difference between diameters of the nanofibers may be not more than approximately 10%, not more than approximately 20% or not more than approximately 30%.

The length of the nanofibers used in the present disclosure is not critical and nanofibers of any length can be used. Generally, the length of the nanofibers is in the range of about 1 μm to about 5 km. In one embodiment, the nanofibers are at least about or about 1 μm in length, or at least about or about 50 μm in length, or at least about or about 1 cm in length, or at least about or about 50 cm in length, or at least about or about 1 m in length, or at least about or about 50 m in length, or at least about or about 100 m in length, or at least about or about 250 m in length, or at least about or about 500 m in length, or at least about or about 1 km in length, or at least about or about 3 km in length, or at least about or about 5 km in length.

The carbon nanotube may be single-walled or multi-walled. In single-walled carbon nanotubes, a one-atom-thick layer of graphite is wrapped into a cylinder. In addition, in multi-walled carbon nanotubes, multiple sheets of graphite are arranged in concentric cylinders.

The carbon nanotube may include a metal nanoparticle. The metal nanoparticle may include transition metals, notably one or more of Fe, Mo, Co, Ni, Ti, Cr, Ru, Mn, Re, Rh, Pd, V or alloys thereof. The metal nanoparticles may have a diameter of about 0.2 nm to about 100 nm, or about 0.5 nm to about 50 nm, or about 1 nm to about 30 nm, or about 2 to about 5 nm.

In some embodiments, the carbon nanotube is associated with the nanofiber so that a longitudinal axis of the carbon nanotube is in a predetermined angle with the longitudinal axis of the nanofiber. The angle may be any angle between about 30° and 90°. The carbon nanotube may be radially oriented to the nanofiber. As used herein, "radially oriented" means the longitudinal axis of the carbon nanotube is substantially orthogonal to the longitudinal axis of the nanofiber. In such a composite structure, a strong lateral pi-pi interaction may be generated between six-membered carbon rings of the carbon nanotubes whose growth direction is radial to the nanofiber. Thus, the strength of the nanofiber may be further reinforced by the strong lateral interaction.

In some embodiments, the carbon nanotube may have a diameter less than that of the nanofiber. For example, the ratio of diameter of the carbon nanotube to the nanofiber may be any ratio between 1:100 and 1:2. For another example, the ratio of diameter of the carbon nanotube to the nanofiber may be 1:100, 1:50, 1:10, 1:5 or 1:2. The diameter of the carbon nanotubes can be controlled to be less than that of the nanofiber by controlling the size of the nanoparticles. The nanoparticles are used as the growth catalyst of the carbon nanotubes, and thus the carbon nanotubes of a smaller diameter can be produced from the nanoparticles of a smaller diameter. For example, carbon nanotubes having diameters of approximately 5 to 30 nm, which are smaller than diameters of nanofibers, can be produced by controlling the size of Fe nanoparticles such that diameters of the Fe nanoparticles have approximately 4 to 8 nm.

The diameter of the carbon nanotube is not critical in the present disclosure, but generally about 0.5 nm to about 500 nm, or about 10 nm to about 100 nm, or about 5 nm to about 20 nm, or about 0.8 nm to about 50 nm or about 1 nm to about 5 nm. The size distribution of the diameter is about 0.3 nm to about 5 nm or about 0.5 nm to about 1.5 nm.

The length of the carbon nanotube is not critical in the present disclosure, but generally has about 1 nm to about 10,000 nm, or about 1 nm to about 1,000 nm, or about 2 nm to about 500 nm, or about 2 nm to about 250 nm, or about 5 nm to about 100 nm, or about 5 nm to about 50 nm.

The composite structure may have entangled structure between carbon nanotubes and carbon nanotubes, or nanofibers and nanofibers, or nanofibers and carbon nanotubes. The entangled composite structure has a strong interaction, for example, a van der Waals interaction between the carbon nanotubes and carbon nanotubes, or the nanofibers and nanofibers, or the nanofibers and carbon nanotubes, which confers high mechanical strength on the structure. The mechanical strength of the composite structure can be determined based on, for example, an elastic modulus by an atomic force microscope (AFM). For additional details on the elastic modulus by the AFM, see G. C. Berry, The Journal of Chemical Physics, 46, 4, 1338 (1967), which is incorporated by reference herein in its entirety. The composite structure also has a large specific surface area due to the carbon nanotubes displaced in a space between the nanofibers. The specific surface area may be determined by standard methods in the art, such as a BET adsorption method. The standard methods are described in, for example, Martinez, M. T et al, Carbon 2003, 41, 2247; Hu, Y. H. et al., E. Ind. Eng. Chem. Res. 2004, 43, 708; and Eswaramoorthy, M. et al., Chem. Phys. Lett. 1999, 304, 207, which are incorporated by reference herein in their entireties.

In addition, the strong pi-pi lateral interaction between the carbon nanotubes reinforces the composite structure. With reference to FIG. 1, one illustrative embodiment of the composite structure is depicted. FIG. 1 shows carbon nanotubes 20 associated with nanofibers 10. FIG. 1 further shows the lateral pi-pi interaction between the carbon nanotubes 20 (as depicted by a circle in FIG. 1), which makes the composite structure very strong. Thus, the illustrative example of the composite structure may be used for reinforcement materials, or functional composites due to its high mechanical strength. By way of examples, the composite structure may be used as catalytic material in a fuel cell due to its high specific surface area. When the composite structure is used as catalytic materials of electrodes of a fuel cell, the large number of metal nanoparticles per unit surface area enhances the catalysis of a fuel cell reaction on the electrodes. The composite structure may also be used in the field of a field emission, or semiconductor device due to the high aspect ratio and semiconducting property of the carbon nanotubes. For additional details on the high aspect ratio and semiconducting property of the carbon nanotubes, see Saito, Y. et al. "Field emission from carbon nanotubes and its applications to electon sources," Carbon 38 (2000) 169-182, and Dresselhaus, M. S. et al, "Semiconducting Carbon Nanotubes," PHYSICS OF SEMICONDUCTORS: 27th International Conference on the Physics of Semiconductors—ICPS-27. AIP Conference Proceedings, Volume 772, pp. 25-31 (2005), which are incorporated by reference herein in their entireties.

Method of Preparing Carbon Nanotube-Nanofiber Composite Structure

In another illustrative example, a method for preparing a composite structure is provided. The method for preparing a composite structure includes associating a metal nanoparticle on at least one nanofiber including one or more of silicon carbide, silicon oxycarbide, silicon nitride and silicon oxide to produce at least one metal nanoparticle-containing nanofiber, and growing at least one carbon nanotube on the nanofiber to obtain a composite structure.

In one embodiment, the metal nanoparticle-containing nanofiber is produced by mixing a silicon-based polymer and a metal nanoparticle to form a metal nanoparticle-containing fiber, and heating the metal nanoparticle-containing fiber at an elevated temperature sufficient to fire the silicon-based polymer to produce the metal nanoparticle-containing nanofiber. By way of example, the silicon-based polymer may include one or more of polycarbosilane, polysilane, polysilazane, and polysiloxane.

The metal nanoparticle-containing fiber can be fabricated by a variety of methods known in the art including, but not limited to, electrospinning, wet spinning, dry spinning, melt spinning, gel spinning and a gas jet method.

In some embodiments, during the electrospinning of the mixture, a polymer solution or a melt is subjected to a high-voltage electrical field to produce an electrically charged jet that typically dries or solidifies to produce a solid fiber. For example, one electrode from a high-voltage source may be placed into a polymer solution and the other electrode from the high-voltage source may be attached to a conducive collector, such as a panel of aluminum foil or a silicon wafer. A polymer solution means a solution of a polymer in a suitable aqueous or organic solvent, and a polymer melt means a polymer in a liquid state.

Figure 2:
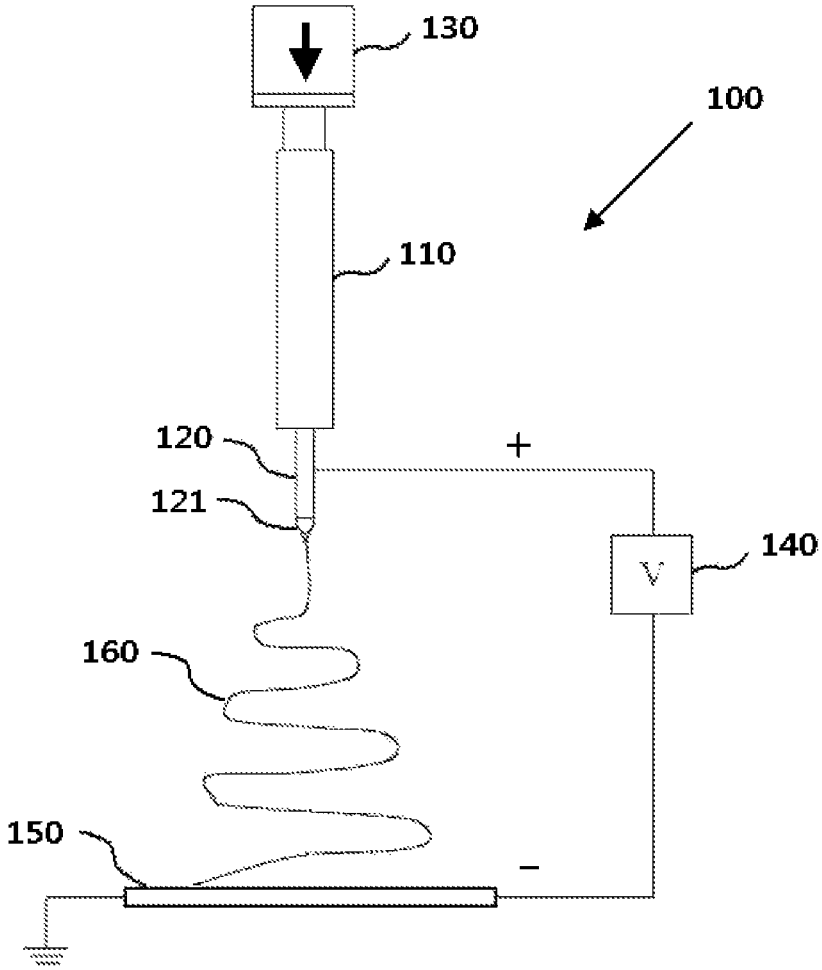
FIG. 2 is a schematic diagram of an illustrative embodiment of an electrospinning apparatus for producing a carbon nanotube-nanofiber composite.

With reference to FIG. 2, an example of an electrospinning apparatus will be described. FIG. 2 is a schematic diagram of an illustrative embodiment of an electrospinning apparatus for producing a carbon nanotube-nanofiber composite structure. An electrospinning apparatus 100 includes a syringe 110 having a metallic needle 120 extended from one end of the syringe 110, a syringe pump 130 that is placed on the other end of the syringe 110 and provides a working fluid, for example, a polymer solution, to the syringe 110, a high-voltage power supply 140 connected to the metallic needle 120, and a grounded collector 150. A polymer solution or melt is loaded into the syringe pump 130, and is driven to a tip 121 of the metallic needle 120, thus forming a droplet suspended at the tip 121. A droplet will naturally be formed when the polymer solution or melt, which is liquid, reaches the tip 121. When a voltage is applied from the high-voltage power supply 140 to the metallic needle 120, the droplet is stretched to form a structure "a Taylor cone". Examples of the structure "Taylor cones" are described in U.S. Patent Application Publication No. 2006/0226580 A1, which is incorporated by reference herein in its entirety. The formed Taylor cone is then turned into an electrified jet. The jet is then elongated and whipped continuously by electrostatic repulsion until it is deposited on the grounded collector 150. The elongation of the jet by bending of the jet results in the formation of uniform fibers 160.

The distance between the tip 121 and the collector 150, i.e., the "discharge distance" is generally varied between about 10 cm and about 30 cm. The diameter of the fibers 160 can be controlled by controlling a discharge rate of the liquid provided from the syringe pump 130. At a given electric voltage, the faster discharge rate of the liquid can make the diameter of the fibers 160 smaller. For example, the discharge rate of the various liquid can be varied between about 0.1 mL/hr and about 100 mL/hr. The electrical voltage applied from the high-voltage power supply 140 can be determined in consideration of the discharge distance. A higher electric voltage is necessary for a longer discharge distance to maintain an adequate discharge rate for electrospinning. For example, the electric voltage can be varied between about 1 kV and about 100 kV for the discharge distance of from about 10 cm to about 30 cm. In one embodiment, the electric voltage is from about 20 kV to about 30 kV for the discharge distance of from about 10 cm to about 15 cm.

In another embodiment, the method for producing the fibers can include forming nanofibers using a gas jet method ("NGJ method"). The NGJ method has been known in one of skilled in the art. Briefly, the NGJ method uses a device having an inner tube and a coaxial outer tube with a sidearm. The inner tube is recessed from the edge of the outer tube thus creating a thin film-forming region. A polymer melt is fed in through the sidearm and fills an empty space between the inner tube and the outer tube. The polymer melt continues to flow toward an effluent end of the inner tube until it contacts an effluent gas jet. The gas jet impinging on a melt surface produces a thin film of the polymer melt, which travels to the effluent end of the tube where it is ejected forming a turbulent cloud of fibers.

Electrospinning and NGJ techniques permit the processing of polymers from both organic and aqueous solvents. For additional detail on the NGJ methods, see the U.S. Pat. Nos. 6,695,992, 6,520,425, and 6,382,526, which are incorporated by reference herein in their entireties. For additional detail on the electrospinning process for producing fibers, see the U.S. Pat. No. 6,753,454, which is incorporated by reference herein in its entirety.

An illustrative embodiment of the method for preparing a composite structure will be described in detail hereinafter. In some embodiments, a mixture containing a silicon-based polymer and one or more metal nanoparticle is electrospun to produce at least one metal-containing fiber.

The silicon-based polymer includes one or more of polycarbosilane, polysilane, polysilazane, and polysiloxane. As used herein the polycarbosilane refers to any polymeric material mainly made of Si—C skeleton structure, the polysilane refers to any polymeric material mainly made of Si—Si skeleton structure, the polysilazane refers to any polymeric material mainly made of Si—N skeleton structure, and the polysiloxane refers to any polymeric material mainly made of Si—O skeleton structure. The polycarbosilane, polysilane, polysilazane, and polysiloxane may have a hydrogen atom, a $C_{1-6}$-alkyl group, a $C_{1-6}$-alkenyl group, an aryl group, a phenyl group or a silyl group as a side chain to the skeleton structure.

Thus, examples of the polycarbosilane include, but are not limited to, polydimethylcarbosilane, and polycarbosilastyrene. Examples of the polysilane include, but are not limited to, polydimethylsilane, polyphenylsilane, polyphenylmethylsilane, polyvinylsilane and polysilastyrene. Examples of the polysilazane include, but are not limited to, polydimethylsilazane, polymethylphenylsilazane, and perhydropolysilazane. Examples of the polysiloxane include, but are not limited to, polydimethylsioxane, polymethylphenylsiloxane, polymethylhydrogensiloxane and polydiphenylsiloxane.

Polycarbosilane, polysilane, polysilazane, and polysiloxane are commercially available in the market. Polycarbosilane may be, for example, obtained as Nipusi® type-A or S from Nippon Carbon Co., Ltd., Tokyo, Japan. Polysilazane may be, for example, obtained as CERASET® Polysilazane 20 from KiON Corporation, 150 East 58th Street, Suite 3238, New York, N.Y. 10155. Polysilane may be, for example, obtained as OGSOL SI-10 or SI-20 series from Osaka Gas Chemicals Co., Ltd., Osaka, Japan. Polysiloxane may be, for example, obtained as HSG-R7 from Hitachi Chemical, Tokyo, Japan.

Alternatively, instead of purchasing the polycarbosilane, polysilane, polysilazane or polysiloxane, they may be synthesized. A method for producing the polycarbosilane is disclosed, for example, in the Japanese Patent Application Laid-open Nos. 51-126300, 52-74000, 52-112700, 54-61299, and 57-16029. A method for producing the polysilane is disclosed, for example, in "Chemistry of Organosilicon Compounds", Kagaku Dojin (1972). A method for producing the polysilazane is disclosed, for example, by K. A. Andrianov in Vysokomolekul. Soedin., Vol. 4, p. 1060 (1962), E. G Rochow in Monatsh. Chem., Vol. 95, p. 750 (1964), W. Fink in Angew. Chem., Vol. 78, p. 803 (1966), U. Wannagat in Fortsch. Chem. Forsh., Vol. 9, p. 102 (1967), and B. J. Aylett in Organometal. Chem. Rev., Vol. 3, p. 151 (1968). The polysiloxane may be prepared in a sol-gel method, as disclosed in, for example, U.S. Pat. No. 4,838,914.

The silicon-based polymer contained in the mixture may be in the form of a solution, or melt. When a solution of the silicon-based polymer is used, the silicon-based polymer is dissolved in an inert solvent. The usable inert solvents include, for example, hydrocarbons, halogenated hydrocarbons, ethers, nitrogen compounds and sulfur compounds. Examples of solvents include hydrocarbons, such as pentane, hexane, isohexane, methylpentane, heptane, isoheptane, octane, isooctane, cyclopentane, methylcyclopentane, cyclohexane, methylcyclohexane, benzene, toluene, xylene and ethylbenzene; halogenated hydrocarbons, such as methylene chloride, chloroform, carbon tetrachloride, bromoform, ethylene chloride, ethylidene chloride, trichloroethane, tetrachloroethane and chlorobenzene; ethers, such as ethyl ether, propyl ether, ethyl butyl ether, butyl ether, 1,2-dioxyethane, dioxane, dimethyldioxane, tetrahydrofuran, tetrahydropyran and anisole; nitrogen compounds, such as diethylamine, triethylamine, piperidine, pyridine, picoline, lutidine, ethylenediamine and propylenediamine; and sulfur compounds, such as carbon disulfide, diethyl sulfide, thiophene and tetrahydrothiophene. In one embodiment, a solvent exhibiting a dielectric characteristic or a polyelectrolytic behavior which is suitable for electrospinning can be used. Such solvents include tetrahydrofuran or toluene.

The silicon-based polymer is dissolved in a suitable amount of the solvent to make a viscous solution. The concentration of the polymer solution is important to the electrospinning process. Electrospinning of very concentrated polymer solution results in fibers with discontinuities. On the other hand, the solutions with insufficient viscosity lead to an unwanted electrospraying of the solution, thereby preventing the formation of fibers by electrospinning. Although an interrelationship between the concentration of the polymer and spinnability of the solution cannot be described in a general manner, since it varies depending on a degree of polymerization of the polymer and a kind and amount of the solvent, a solution having a viscosity at room temperature of about 1 poise to about 5,000 poises can be used.

The electrospinning is effected in an inert gas atmosphere at room temperature or, if necessary, by heating the solution. In the latter case, the heating should be performed carefully to avoid a thermal decomposition of the polymer. After the electrospinning, the fibers are dried either by heating under a reduced pressure, or passing a hot inert gas over them. The dry fibers may be heat-treated at around 100° C. in an inert gas atmosphere, to ensure that the solvent from the solution is removed and to minimize formation of cracks, voids and pores during the firing step.

When a melt of the silicon-based polymer is used as the working fluid of the electrospinning process, the heating temperature of the polymer varies depending on a softening temperature of the polymer, but the temperature is about 50° C. to about 400° C.

Suitable metals for the metal nanoparticle include the group of transition metals including Fe, Mo, Co, Ni, Ti, Cr, Ru, Mn, Re, Rh, Pd, V or alloys thereof. Such metal nanoparticles and preparation method thereof are well known to those skilled in the art. Examples of methods for preparing metal nanoparticles include a solution method and a vapor phase method. The solution method is discussed in, for example, Trindale T et al., *Nanocrystalline semiconductors: synthesis, properties, and perspectives*. Chem. Mater. 2001; 13:3843-58, and Murray C B et al., *Synthesis and characterization of monodisperse nanocrystals and close-packed nanocrystal assemblies*. Annu. Rev. Mater. Sci. 2000; 30:545-610, which are incorporated herein by references in their entireties. The vapor phase method is discussed in, for example, Mark T. Swihart, Vapor-phase synthesis of nanoparticles. Curr. Opin. Colloid. Interf. Sci. 2003; 8:127-133, which is incorporated herein by a reference in its entirety. The metal nanoparticles may have a diameter of about 0.2 nm to about 100 nm, or about 0.5 nm to 30 nm.

The metal nanoparticles are added to the solution or melt of polymer to prepare a mixture containing a silicon-based polymer and metal nanoparticles. The concentration of the metal nanoparticles may be about 0.5 to about 60 wt %, about 5 to about 50 wt %, or about 10 to about 40 wt % based on the weight of the polymer. The prepared mixture containing a silicon-based polymer and one or more metal nanoparticle may be subjected to a filtration to remove macrogel, impurities and other substances harmful to electrospinning.

An electrospinning speed for the mixture varies depending on an average molecular weight, a molecular weight distribution, and a molecular structure of the silicon-based polymer. The electrospinning speed in a range of about 50 m/min to about 5,000 m/min generally brings about an advantageous effect, such as a uniform diameter of a fiber along its length. To provide an adequate electrospinning speed, the molecular weight of the polymer may be between about 600 and about 50,000, or about 800 and about 30,000.

The morphology of the fibers depends on the type of polymer used and the spinning condition. Although most of the fibers that are produced through electrospinning are circular solid filaments, beaded structures or non-uniform structures may be formed when a slow spinning condition or a polymer of high molecular weight is used. The electrospun fibers may be in the form of single fibers, linear fiber assemblies (yarns) or a nonwoven or woven web. As-spun fibers each have the form of single fibers. Linearly aligned single fibers form linear fiber assemblies or yarns. When electrospun fibers are randomly collected on a sheet, they will typically form a nonwoven web. The woven web of electrospun fibers are formed by weaving or knitting of the single fibers or linear fiber assemblies.

In one embodiment, the electrospun fibers are preheated under an oxidizing atmosphere at a low temperature of about 50° C. to about 400° C., or about 150° C. to about 300° C. for several minutes to about 10 hours prior to the heating or firing of the fibers. During the preheating process, a thin oxide layer is formed on the surface of the fibers under an oxidizing atmosphere. Thus, the fibers are not melted during the heating or firing and the stickiness of neighboring fibers can be prevented.

The at least one metal nanoparticle-containing fiber is then heated at an elevated temperature sufficient to fire the silicon-based polymer to produce the metal nanoparticle-containing nanofiber. During the firing, the silicon-based polymer forming the fiber easily emanates volatile components by thermal polycondensation reaction, and thermal cracking reaction. By the thermal polycondensation reaction, a linear silicon-based polymer becomes a three-dimensional structure in which a basic skeleton, such as Si—C, Si—N and Si—O—C, is repeated. By the thermal cracking reaction, atoms other than those constituting the basic skeleton are removed by forming simple molecules, such as methane and hydrogen. For example, the firing of polycarbosilane, polysilane, polysilazane, or polysiloxane results insilicon carbide, silicon carbide, silicon nitride, or silicon oxycarbide, respectively. The firing is generally conducted until the formation of the volatile components, which are by-products of heating, ceases. Although the time for ceasing is not particularly limited, it is generally about 8 h to about 20 h, or about 10 h to about 16 h.

The firing of the fiber may be carried out in an inert atmosphere. The inert atmosphere includes one or more of argon, helium, molecular nitrogen or CO.

In another embodiment, the firing of the polysiloxane-based fiber may be carried out in an oxidizing atmosphere. In this case, silicon oxide-based nanofibers instead of silicon oxycarbide can be dominantly obtained due to the abundance of oxygen. The oxidizing atmosphere includes one or more of molecular oxygen or water vapor.

In still another embodiment, the heating of the polycarbosilane or polysilazane-based fiber may be carried out in an ammonia gas atmosphere to produce the silicon nitride-based nanofiber. Because polysilazane is an organosilicon high molecular weight compound composed mainly of Si—N skeleton structure, a compound having Si and N is obtained even when the polysilazane fiber is fired in an inert atmosphere, such as argon. When an ammonia gas is used in the firing of the polysilazane fiber, a carbon content in the nanofiber is reduced. Accordingly, it can prevent the mechanical strength of the nanofiber from deteriorating at high temperatures by reducing the carbon content in the nanofiber.

The firing temperature is usually in the range between about 100° C. and about 2100° C. At a firing temperature not less than about 100° C., the firing may be completed within about 20 hours. At a firing temperature not more than about 2100° C., the firing may be economically carried out without using an excessive heating and/or the thermal decomposition of the nanofibers may be eliminated or reduced.

In another embodiment, the metal nanoparticle-containing nanofiber is produced by mixing the metal nanoparticle with the at least one nanofiber, and heating the mixture to produce the metal nanoparticle-containing nanofiber.

In this embodiment, the nanofiber may be produced as in the previous embodiment, but also be purchased from commercially available manufacturers. For example, nanofibers of silicon carbide, silicon oxycarbide, silicon nitride or silicon oxide may be obtained from Nippon Carbon, Co., Ltd, Dow Corning Corporation, or Union Carbide Corporation.

The metal nanoparticle is mixed with the nanofiber in an inert solvent. By way of examples, the inert solvent may include, for example, hydrocarbons, halogenated hydrocarbons, ethers, nitrogen compounds or sulfur compounds as described above.

The mixture of the metal nanoparticle and the nanofiber is heated to associate the metal nanoparticle with the nanofiber. The heating temperature may be in the range between about 100° C. and about 2100° C. At a heating temperature not less than about 100° C., the heating may be completed within about 20 hours. At a heating temperature not more than about 2100° C., the heating may be economically carried out without using an excessive heating and/or the thermal decomposition of the nanofibers may be eliminated or reduced.

In still another embodiment, the metal nanoparticle-containing nanofiber is produced by mixing a metal salt with the at least one nanofiber, and heating or reducing the metal salt on the at least one nanofiber to produce the metal nanoparticle-containing nanofiber.

A metal salt is mixed with the nanofiber in aqueous solution. The concentration of the metal salt solution may be in the range from about 0.01 mol/L to about 10 mol/L, or from about 0.1 mol/L to about 5 mol/L, or from 0.5 mol/L to about 1 mol/L. Suitable metal salts include, but are not limited to, bromides, chlorides, carbonates, hydrogen carbonates, sulfates, nitrates, phosphates, acetates, formates, or oxalates of Fe, Mo, Co, Ni, Ti, Cr, Ru, Mn, Re, Rh, Pd, or V.

During the heating the mixture of the metal salt and the nanofiber, the metal salt thermally decomposes into a metal nanoparticle and volatile species, such as $H_2$, $Cl_2$, $O_2$, and $N_2$. The heating temperature may be in the range between about 100° C. and about 2100° C. At a heating temperature not less than about 100° C., the heating may be completed within about 20 hours. At a heating temperature not more than about 2100° C., the heating may be economically carried out without using an excessive heating and/or the thermal decomposition of the nanofibers may be eliminated or reduced.

On the other hand, the metal salt may be reduced to a metal nanoparticle by a reducing atmosphere, such as hydrogen gas or carbon monoxide gas. Alternatively, the metal salt may be reduced by a reducing agent, such as metal borohydrides and metal hydrides.

In this embodiment, the nanofiber may be produced as in the previous embodiment, but also be purchased from commercially available manufacturers. For example, nanofibers of silicon carbide, silicon oxycarbide, silicon nitride or silicon oxide may be obtained from Nippon Carbon, Co., Ltd, Dow Corning Corporation, or Union Carbide Corporation.

In one embodiment, the carbon nanotubes may grow from the metal nanoparticles on the nanofiber. The carbon nanotube may be grown by chemical vapor deposition (CVD) or plasma enhanced vapor deposition (PECVD) process using one or more carbon containing precursors. During the CVD or PECVD process, a reaction chamber is heated to a high temperature and a carbon containing precursor flows through the reactor for a period of time. The high temperature ("growth temperature") for growing the carbon nanotubes may be about 500° C. to about 1200° C. A growth temperature for multiwall carbon nanotubes may be about 550° C. to about 800° C. and a growth temperature for single wall carbon nanotubes may be about 850° C. to about 1000° C. The specific growth temperature may depend on a particular composition of the metal nanoparticles, as well as a particular composition of the carbon containing precursors. It will be apparent to those skilled in the art that the growth temperature does not need to be held constant and can be ramped or stepped either up or down during the growth process. It is noted that multi-walled nanotubes can be grown at temperatures, as low as about 150° C. by using the PECVD process.

It is well known in the art that a diameter of a carbon nanotube is proportional to a diameter of a metal particle used for its synthesis via the CVD process. Thus, a size of the nanoparticle used can define the diameter of the carbon nanotubes. The diameter of the carbon nanotube may be about 0.5 nm to about 100 nm, or about 0.8 nm to about 50 nm, or about 1 nm to about 5 nm. The size distribution of the diameter may be about 0.3 nm to about 5 nm or about 0.5 nm to about 1.5 nm.

Suitable carbon containing precursors include, but are not limited to, aliphatic hydrocarbons, aromatic hydrocarbons, carbonyls, halogenated hydrocarbons, silyated hydrocarbons, alcohols, ethers, aldehydes, ketones, acids, phenols, esters, amines, alkylnitrile, thioethers, cyanates, nitroalkyl, alkylnitrate, and/or mixtures of one or more of the above, and more typically methane, ethane, propane, butane, ethylene, acetylene, carbon monoxide, benzene and methylsilane. Other reactive gases, such as hydrogen and ammonia, which play an important role in CNT growth by forming a volatile chemical species with the carbon containing precursors, may also be introduced. Also, carrier gases, such as argon, nitrogen and helium can be introduced.

The time during which the carbon containing precursor resides in the reaction chamber ("residence time") can be controlled by a gas flow rate and/or a growth pressure of the reaction chamber by means of a gas valve. By adjusting the residence time, such as by adjusting the gas flow rate and/or the growth pressure, the diameter of the carbon nanotube can be controlled. For example, for a given growth pressure, an increase in the gas flow rate reduces the residence time, while for a given gas flow rate, an increase in the growth pressure enhances the residence time.

The residence time may be about 1 minute to about 20 minutes or about 1.2 minutes to about 10 minutes. The gas flow rate may be about 1 sccm to about $10^4$ sccm, or about 20 sccm to about 2000 sccm. The growth pressure may be about 1 mTorr to about 760 Torr, or about 1 Torr to about 760 Torr.

Figure 3:
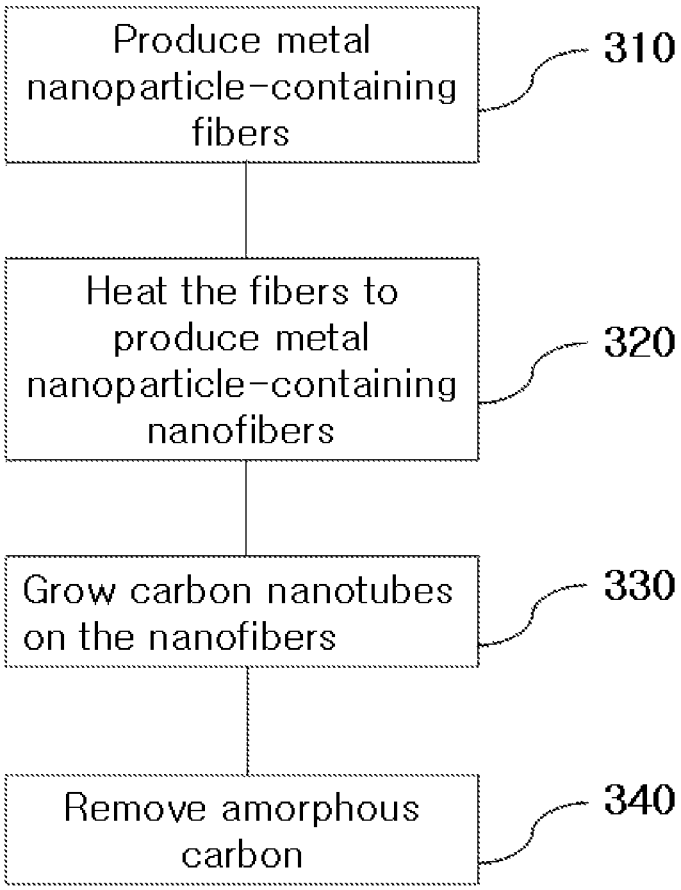
FIG. 3 is a schematic diagram of one embodiment of the method of preparing a composite structure.

FIG. 3 is a schematic diagram of an illustrative embodiment of the method for preparing the composite structure. As described above, metal nanoparticle-containing fibers are produced from a mixture containing a silicon-based polymer and a metal nanoparticle (block 310). The produced fibers are heated to fire the silicon-based polymer to produce metal nanoparticle-containing nanofibers (block 320). Next, carbon nanotubes are grown on the nanofibers to obtain a composite structure (block 330). In some embodiments, the method may optionally include removing amorphous carbon (block 340). Particularly, the carbon nanotube-nanofiber composite structure may be further treated in acidic conditions to remove amorphous carbon which is produced as a byproduct of the carbon nanotube growth. The acidic condition may be an inorganic acid, such as a nitric acid and a sulfuric acid. Removal of the amorphous carbon leads to very strong lateral pi-pi interaction between π-electrons of many six-membered carbon rings of carbon nanotubes whose growth direction is radial to the nanofiber. Such a strong lateral interaction reinforces the strength of the nanofiber. Further, by treating the carbon nanotube-nanofiber composite structure in the acidic conditions, the metal nanoparticle that is served as a catalyst or a nucleating agent for the growth of the carbon nanotube may also be removed.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A method for preparing a composite structure, comprising:

mixing a metal nanoparticle with at least one nanofiber in an inert solvent to form a mixture, wherein the at least one nanofiber comprises silicon nitride; and heating the mixture to a temperature effective to associate the metal nanoparticle with the at least one nanofiber; and growing at least one carbon nanotube on the at least one nanofiber to obtain a composite structure.

2. The method of claim 1, further comprising removing amorphous carbon from the composite structure.

3. The method of claim 2, wherein the removing amorphous carbon from the composite structure is carried out by treating the composite structure with an acid.

4. The method of claim 1, wherein the metal nanoparticle comprises one or more of Fe, Mo, Co, Ni, Ti, Cr, Ru, Mn, Re, Rh, Pd, V or alloys thereof.

5. The method of claim 1, wherein the temperature is about 100° C. to about 2100° C.

6. The method of claim 1, wherein the at least one carbon nanotube is single-walled or multi-walled.

7. The method of claim 1, wherein the at least one carbon nanotube grows from the metal nanoparticle on the at least one nanofiber.

8. The method of claim 1, wherein the inert solvent comprises at least one member selected from the group consisting of hydrocarbons, halogenated hydrocarbons, ethers, nitrogen compounds, sulfur compounds, and combinations thereof.

9. The method of claim 1, further comprising:

wherein the at least one nanofiber comprises a plurality of nanofibers and the at least one carbon nanotube comprises a plurality of carbon nanotubes; and forming an entangled structure of the plurality of nanofibers and the plurality of nanotubes.

10. A method for preparing a composite structure, comprising:

heating at least one nanofiber to form at least one silicon nitride based nanofiber, the at least one nanofiber comprising polysilazane;

mixing a metal nanoparticle with the at least one silicon nitride based nanofiber in an inert solvent to form a mixture;

heating the mixture to a temperature effective to associate the metal nanoparticle with the at least one silicon nitride based nanofiber, the temperature being in a range from about 100° C. to about 2100° C.; and growing at least one carbon nanotube on the at least one silicon nitride based nanofiber to obtain a composite structure.

11. The method of claim 10 wherein growing at least one carbon nanotube on the at least one silicon nitride based nanofiber to obtain a composite structure comprises growing the at least one carbon nanotube on the at least one silicon nitride based nanofiber to form an entangled structure.

12. The method of claim 10 wherein growing at least one carbon nanotube on the at least one silicon nitride based nanofiber to obtain a composite structure comprises growing the at least one carbon nanotube on the at least one silicon nitride based nanofiber so that the at least one carbon nanotube is radially oriented relative to the at least one nanofiber.

13. The method of claim 10 wherein the nanotube diameter is in a range from about 10 to about 500 nanometers.

14. The method of claim 10 wherein the at least one carbon nanotube has a length of about 10 nanometers to about 10,000 nanometers.

15. A method for preparing a composite structure, comprising:

heating at least one nanofiber in an ammonia gas atmosphere to form at least one silicon nitride based nanofiber, the at least one nanofiber comprising polysilazane;

mixing a metal nanoparticle with the at least one silicon nitride based nanofiber in an inert solvent to form a mixture;

heating the mixture to a temperature effective to associate the metal nanoparticle with the at least one silicon nitride based nanofiber; and growing at least one carbon nanotube on the at least one silicon nitride based nanofiber to obtain a composite structure, a ratio of a nanotube diameter of the at least one carbon nanotube to a nanofiber diameter of the at least one silicon nitride based nanofiber being in a range from about 1:100 to about 1:2.

16. The method of claim 15, wherein the metal nanoparticle comprises at least one metal selected from the group consisting of Fe, Mo, Co, Ni, Ti, Cr, Ru, Mn, Re, Rh, Pd, and V.

17. The method of claim 15, wherein the temperature is in a range from about 100° C. to about 2100° C.

18. The method of claim 15, wherein:

the at least one silicon nitride based nanofiber comprises a plurality of silicon nitride based nanofibers and the at least one carbon nanotube comprises a plurality of carbon nanotubes; and growing at least one carbon nanotube on the at least one silicon nitride based nanofiber to obtain a composite structure comprises forming an entangled structure from the plurality of silicon nitride based nanofibers and the plurality of nanotubes.

* * * * *

UNITED STATES PATENT AND TRADEMARK OFFICE

CERTIFICATE OF CORRECTION

PATENT NO. : 8,431,189 B2
APPLICATION NO. : 12/645219
DATED : April 30, 2013
INVENTOR(S) : Lee It is certified that error appears in the above-identified patent and that said Letters Patent is hereby corrected as shown below:

On the Title Page, Item (56), under "OTHER PUBLICATIONS", in Column 2, Line 1, delete "al "VO Nanorods on TiO nanofiers:" and insert -- al., "VO Nanorods on TiO nanofibers: --, therefor.

On the Title Page, Item (56), under "OTHER PUBLICATIONS", in Column 2, Line 3, delete "No. 6" and insert -- No. 6, --, therefor.

On the Title Page, Item (56), under "OTHER PUBLICATIONS", in Column 2, Line 8, delete "al" and insert -- al., --, therefor.

On the Title Page, Item (56), under "OTHER PUBLICATIONS", in Column 2, Line 10, delete "(2003)" and insert -- (2003), --, therefor.

On the Title Page, Item (56), under "OTHER PUBLICATIONS", in Column 2, Line 11, delete "al" and insert -- al., --, therefor.

On the Title Page, Item (56), under "OTHER PUBLICATIONS", in Column 2, Line 13, delete "al" and insert -- al., --, therefor.

On the Title Page, Item (56), under "OTHER PUBLICATIONS", in Column 2, Line 15, delete "1999)" and insert -- 1999), --, therefor.

On the Title Page, Item (56), under "OTHER PUBLICATIONS", in Column 2, Line 16, delete "al" and insert -- al., --, therefor.

On the Title Page, Item (56), under "OTHER PUBLICATIONS", in Column 2, Line 17, delete "2000)" and insert -- 2000), --, therefor.

Signed and Sealed this
Eleventh Day of March, 2014

Michelle K. Lee

Michelle K. Lee
*Deputy Director of the United States Patent and Trademark Office*

On Title Page 2, Item (56), under "OTHER PUBLICATIONS", in Column 1, Line 1, delete "al" and insert -- al., --, therefor.

On Title Page 2, Item (56), under "OTHER PUBLICATIONS", in Column 1, Line 5, delete "95" and insert -- 95, --, therefor.

On Title Page 2, Item (56), under "OTHER PUBLICATIONS", in Column 1, Line 10, delete "al" and insert -- al., --, therefor.

On Title Page 2, Item (56), under "OTHER PUBLICATIONS", in Column 1, Line 12, delete "al" and insert -- al., --, therefor.

On Title Page 2, Item (56), under "OTHER PUBLICATIONS", in Column 1, Line 16, delete "(2003)" and insert -- (2003), --, therefor.

On Title Page 2, Item (56), under "OTHER PUBLICATIONS", in Column 1, Line 26, delete "2005" and insert -- 2005, --, therefor.

On Title Page 2, Item (56), under "OTHER PUBLICATIONS", in Column 1, Line 28, delete "2004" and insert -- 2004, --, therefor.

On Title Page 2, Item (56), under "OTHER PUBLICATIONS", in Column 2, Line 9, delete "2007" and insert -- 2007, --, therefor.

On Title Page 2, Item (56), under "OTHER PUBLICATIONS", in Column 2, Line 23, delete "nanofibres,"" and insert -- nanofibers," --, therefor.

In the Specification

In Column 5, Line 30, delete "electon" and insert -- electron --, therefor.

In Column 7, Line 30, delete "polydimethylsioxane," and insert -- polydimethylsiloxane, --, therefor.

In Column 7, Line 52, delete "G" and insert -- G. --, therefor.

In Column 11, Line 13, delete "enhanced vapor" and insert -- enhanced chemical vapor --, therefor.